US006986433B2

(12) United States Patent
Colford et al.

(10) Patent No.: US 6,986,433 B2
(45) Date of Patent: Jan. 17, 2006

(54) CONTAINER EQUIPPED WITH AT LEAST ONE DEFORMABLE CLOSURE DEVICE

(75) Inventors: Nicholas Alan Timothy Colford, Bristol (GB); Frits Frederik DeJong, Sankt Augustin (DE)

(73) Assignee: Agence Spatiale Europeenne, Paris (FR)

( * ) Notice: Subject to any disclaimer, the term of this patent is extended or adjusted under 35 U.S.C. 154(b) by 0 days.

(21) Appl. No.: 09/934,082

(22) Filed: Aug. 22, 2001

(65) Prior Publication Data

US 2002/0047012 A1 Apr. 25, 2002

(30) Foreign Application Priority Data

Aug. 22, 2000 (FR) ..... 00 10792

(51) Int. Cl.
*B65D 51/00* (2006.01)

(52) U.S. Cl. ..... 220/229; 220/200; 220/916

(58) Field of Classification Search ..... 220/229, 220/200, 916; 383/43, 71, 75; 137/317, 137/849; 215/247
See application file for complete search history.

(56) References Cited

U.S. PATENT DOCUMENTS 478,873 A * 7/1892 Koehler ..... 383/43
2,446,577 A * 8/1948 Drane et al. ..... 251/212
2,509,688 A * 5/1950 Loosli ..... 279/46.1
2,685,981 A * 8/1954 Jones ..... 220/200
2,751,952 A * 6/1956 Mirus ..... 383/41
3,930,413 A * 1/1976 Laird et al. ..... 137/317
4,078,686 A * 3/1978 Karesh ..... 220/916
4,109,836 A * 8/1978 Falarde ..... 222/494
4,308,885 A * 1/1982 Geisseler ..... 137/67
4,328,904 A * 5/1982 Iverson ..... 220/229
4,416,308 A * 11/1983 Bower ..... 137/846
5,328,041 A * 7/1994 Hook et al. ..... 215/247
5,988,468 A * 11/1999 Murdoch et al. ..... 383/43
6,186,997 B1 * 2/2001 Gabbard et al. ..... 215/247

FOREIGN PATENT DOCUMENTS

GB 2 041 332 9/1980

* cited by examiner

*Primary Examiner*—Robin A. Hylton
(74) *Attorney, Agent, or Firm*—Morgan, Lewis & Bockius, LLP

(57) ABSTRACT

A container equipped with a closure device that allows an object to be placed in said container, particularly for the purposes of manipulating it, or allows it to be withdrawn from said container, the closure device having a plane and comprising a closure mechanism that can deform elastically to change from a closed state of rest under no external stress to an open active state under an external stress. The closure mechanism can deform elastically and radially essentially in the plane of the closure device.

14 Claims, 4 Drawing Sheets

CONTAINER EQUIPPED WITH AT LEAST ONE DEFORMABLE CLOSURE DEVICE

Figure 1:
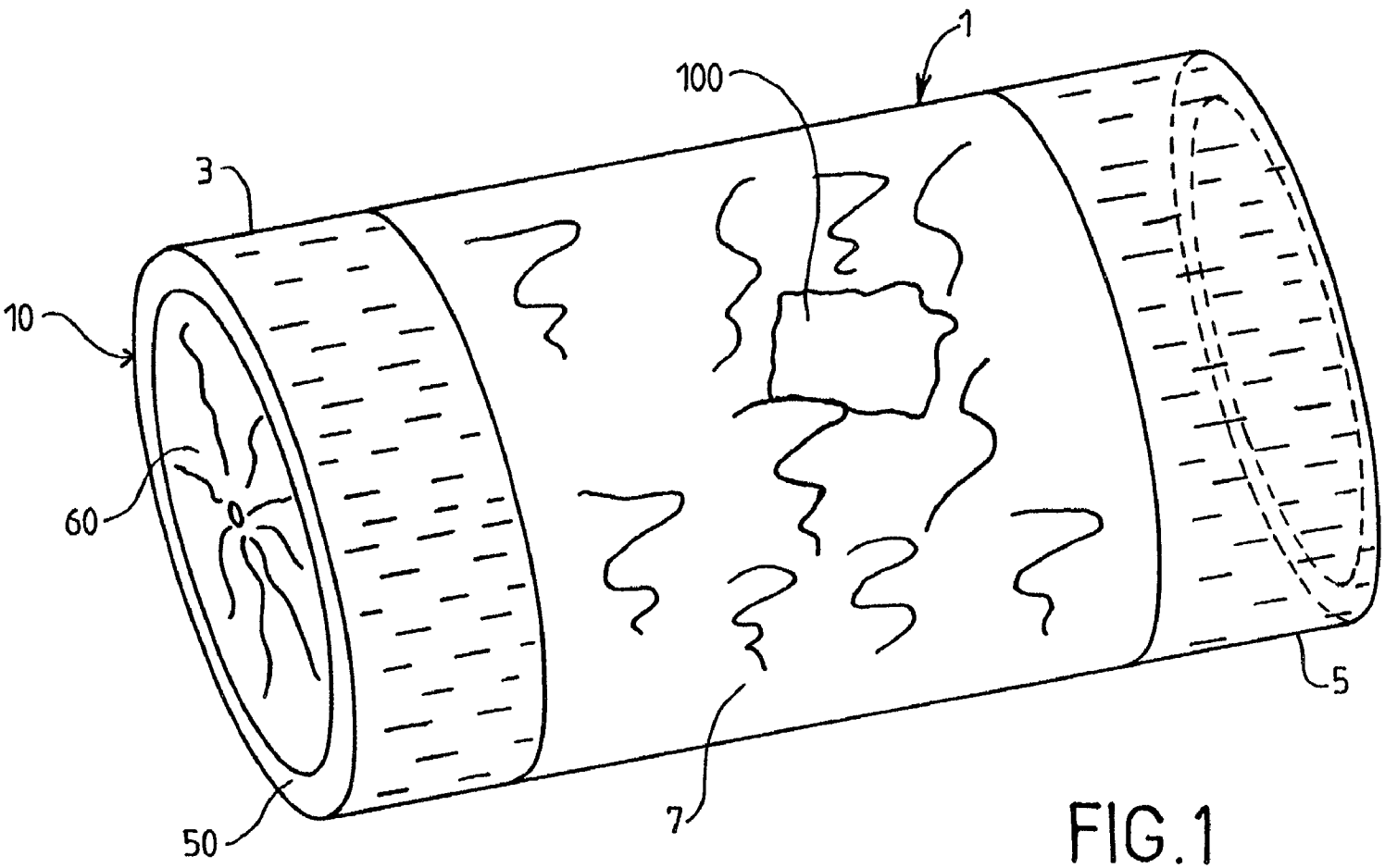

The invention relates to a container that is usable particularly under conditions of weightlessness and is equipped with at least one closure device.

In zero gravity, any object placed in a container and not attached, floats about. When the container is opened, it therefore tends to escape from the container freely. This means that great care must be exercised when opening the container (a box, a pocket of a garment, a cupboard) if it contains an object. This problem can be quantified by considering the size of the opening of the container and the number of times this opening is accessed to open the container. It is therefore most important, in particular when carrying out experiments in zero gravity (or in microgravity) or in the day-to-day life of astronauts under weightless conditions, that objects should not be allowed to escape so freely from their containers and get in the astronauts' way. Efforts have therefore already been made to solve this problem in the past.

Thus, in this particular field, various container closure devices are known which are simple to make and use, such as zippers, "Velcro" (registered trademark) or a diaphragm-type device. However, these devices do not keep the object securely in the container and prevent it escaping therefrom because these devices require deliberate manipulation to open and reclose them (rotation in the case of the diaphragm, translation in the case of the zipper, and touching together of the two parts in the case of "Velcro"). Thus, once opened, these devices do not automatically reclose to trap the object inside the container. The problem is exacerbated by the fact that under weightless conditions the astronaut is generally using one hand to keep himself still (because he is floating too). He therefore only has one hand to use to open the container, withdraw (or manipulate) an object contained inside it, and reclose said container.

U.S. Pat. No. 2,710,387, which relates to a quite different field, discloses a closure device for an incubator through which the hands can be inserted to handle a newborn baby. This device is composed of a thin disk of deformable material (such as rubber) divided into several portions (plates or sectors, for example) which can deform in a plane generally perpendicular to the closure device (into or out of the container) as a hand or an object passes through. To introduce an object or a hand into the container, the plates are pushed apart into the container to create a sufficient opening between them. As a rule, once the object is in the container and the hand withdrawn, the sectors automatically return elastically to their closure position to seal the container again. This return to the rest state is generally rather slow because this elasticity must not present too great an obstacle to the insertion of the object or hand. To withdraw the object from the container, the reverse action is carried out, causing the plates to move apart elastically out of the container.

However, in a hypothetical use under weightless conditions, or in any other use in which the container may be placed in any position (particularly with its opening pointing down) to allow objects to be manipulated inside it, there is no guarantee with a device of that kind that the object will remain in the container. For example it may come out if the container is disturbed by pressing on the plates. These plates may also lose their elasticity over time, and they often leave large openings around the object (or hand) when the object is being inserted, and in the particular case of use under weightless conditions, the object contained inside the container may then come out of its own accord, the plates having lost all of their elasticity.

It is therefore an object of the invention to solve these problems in the context particularly of use under weightless conditions.

To this end, the invention provides a container equipped with a closure device that allows an object to be placed in said container, particularly for the purposes of manipulating it, or allows it to be withdrawn from said container, the closure device having a plane and comprising closure means that can deform elastically to change from a closed state of rest under no external stress to an open active state under an external stress, the container being characterized in that said closure means can deform elastically essentially in the plane of the closure device.

As a complementary feature, the closure device will comprise at least one rigid peripheral support structure to which are attached the elastically deformable means which intersect each other and surround a closure member in such a way as to tend to close it.

In particular, the peripheral structure will preferably be a rigid frame on which the elastically deformable means will then be stretched between two roughly opposite points.

More specifically, the peripheral structure may comprise at least one ring having an inside diameter and a center, and the elastically deformable means may be elastic bands attached in groups of two juxtaposed elastic bands fixed to the ring at their diametrically opposed ends.

As another feature, the closure member will be a sleeve made of flexible material having a diameter and a length of at least twice this diameter, each end of which sleeve passes through each pair of elastic bands approximately in the center of the ring where it is contracted radially in the closed rest state of the device, or defines a single through opening for the object in the open state of the device, in which state the elastic bands are deformed radially by the passage of said object.

As a complementary feature, one end of the sleeve may be fixed peripherally to an outer face of a second ring and the other end of said sleeve will then be fixed peripherally to an opposite outer face of a first ring identical to the other ring, the sleeve being contracted approximately in a middle zone between each pair of elastic bands, the latter being attached to one or other of the rings which are themselves fixed via their inner faces.

In order to improve the closure of the device and ensure that the object or objects placed in the container do not easily come out again, the two rings will be offset angularly with respect to each other while twisting the sleeve axially, this angular offset being preferably approximately 90°.

As a complementary feature of the invention relating to the making of a self-contained assembly, the rings are held together by adhesive bonding or by stitching.

In accordance with another consideration, the sleeve may be made of fabric.

To ensure that the contraction of the sleeve is effective and equally distributed peripherally, the elastic bands will be eight in number and juxtaposed and attached in pairs distributed in such a way as to pass through the center of their supporting ring so as to form in the latter eight essentially identical sectors.

For the same reason, the elastic bands will be slightly under tension on their supporting ring in the closed state of the device.

As an another feature of the invention, the shape of the container will be that of a straight or curved cylinder and it will then possess a closure device at each end. In this way the user can insert both hands into the container to manipulate objects placed inside it without the danger that they will escape from said container.

In order that the user can see the object being manipulated inside the container, the container will include at least a part made of a transparent material.

Figure 2:
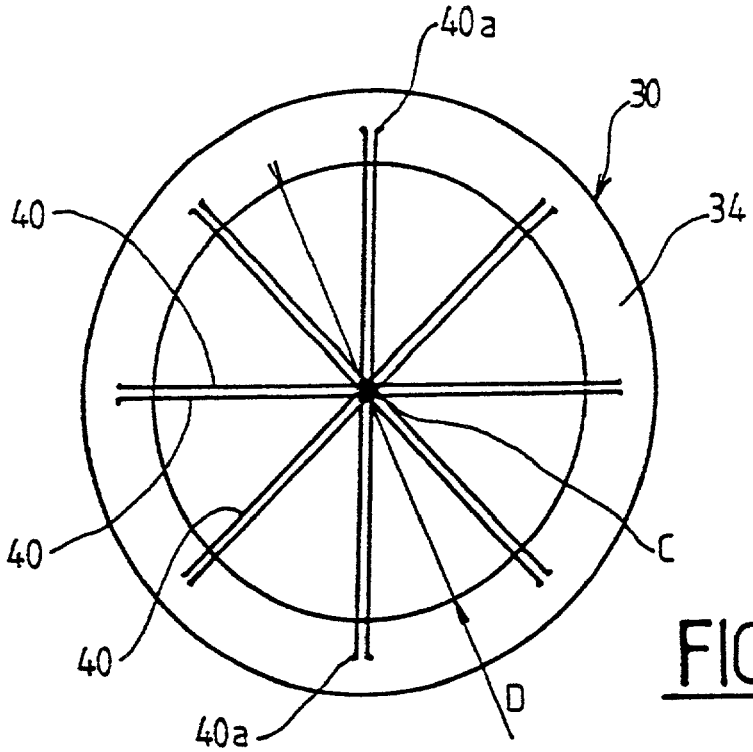
Figure 3:
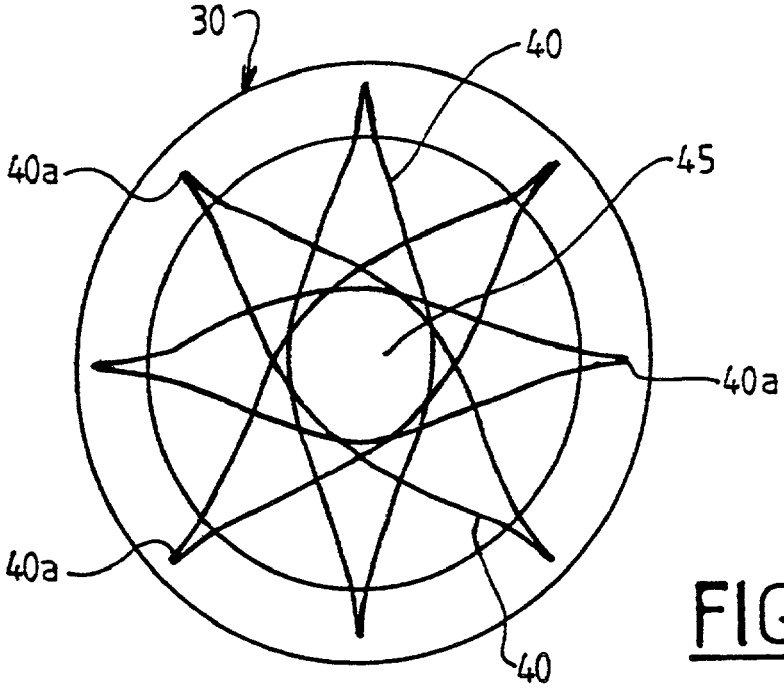
Figure 4:
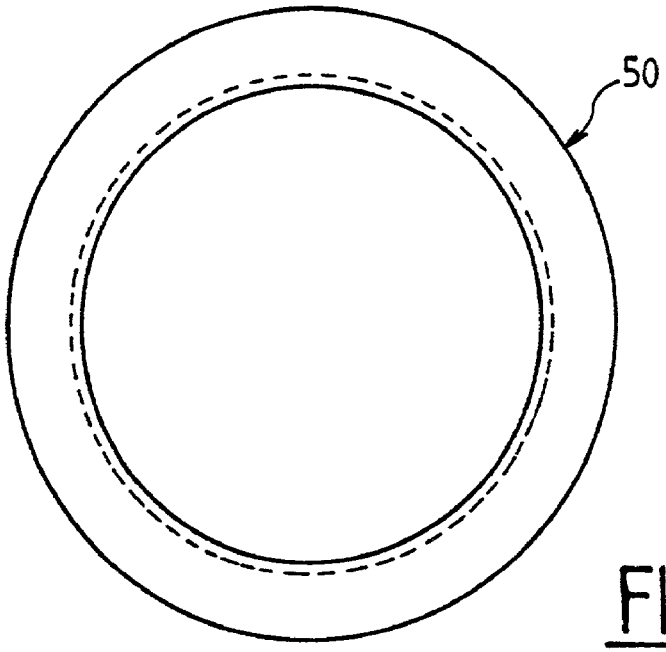
Figure 5:
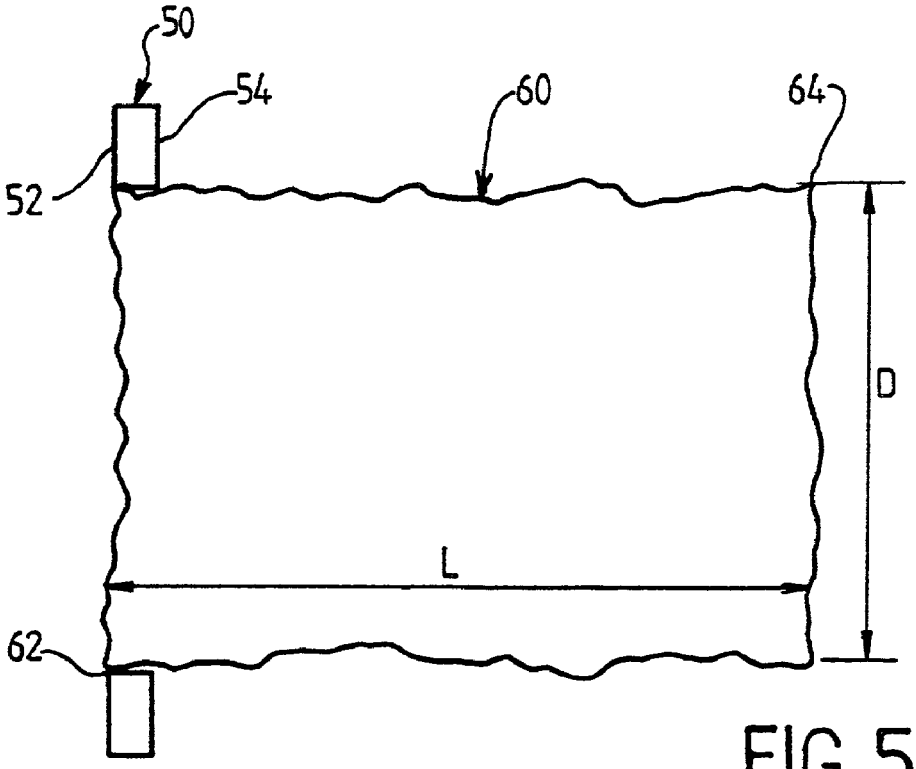
Figure 6:
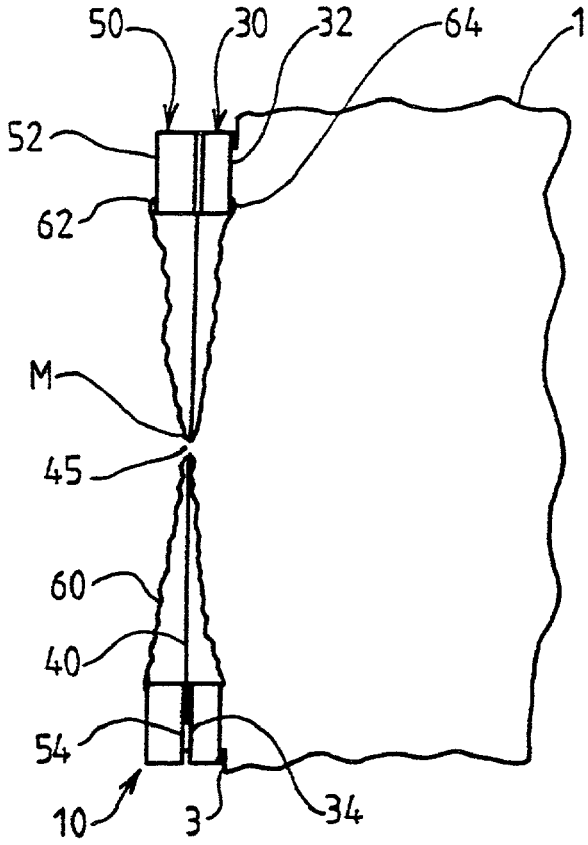
Figure 7:
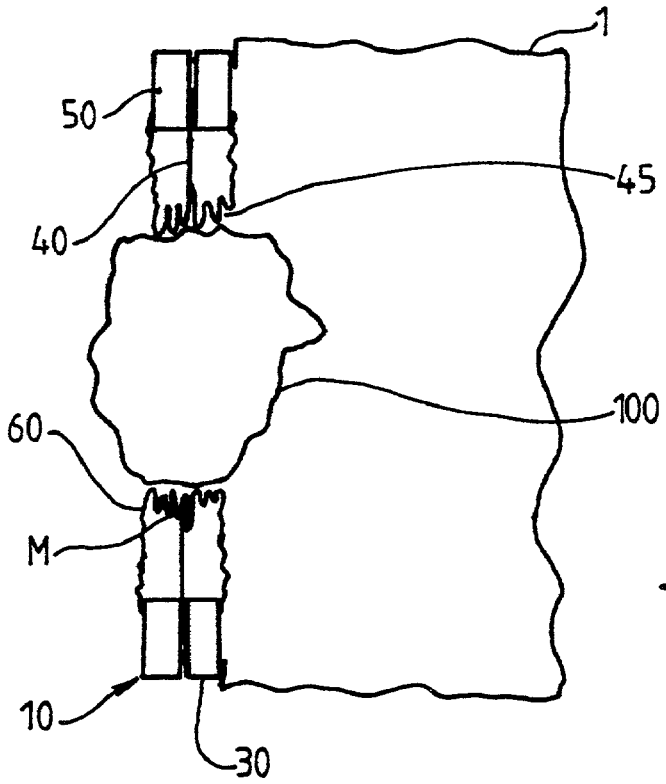

A clearer understanding of the invention and of other characteristics, details and advantages thereof will be gained from a reading of the description which follows, given by way of example with reference to the accompanying drawings, in which:

FIG. 1 is a perspective view of a container in accordance with the invention, FIG. 2 is an end view of a first part of the container closure device, FIG. 3 is a view similar to FIG. 2 but with the device in its open state, FIG. 4 is an end view of a second part of the container closure device, FIG. 5 is a cross section through FIG. 4, FIG. 6 is a view in cross section through the closure device following assembly and in its closed state, under no external stress, and FIG. 7 is a view similar to FIG. 6 but with the closure device in its open state.

FIG. 1 shows a container 1 that can be used in particular under conditions of weightlessness by astronauts carrying out, for example, experiments in a space station. It takes the form of a long, preferably flexible tube of e.g. fabric, each of its ends 3 and 5 being provided with a closure device 10 as described later. Its body also includes a see-through wall 7 so that the manipulator can see what he is doing inside the container. The user can thus manipulate tools and objects 100 for a zero-gravity experiment, without their escaping from the container during the manipulation or after withdrawal of their hands.

In FIG. 2, a first support ring 30 belonging to the closure device 10 of the invention is shown. This flat ring 30 of center C and of inside diameter D has a radial part to the inner surface 34 of which are attached the ends 40*a* of eight elastic bands 40 whose length is slightly greater than D (to enable them to be fixed more easily to this radial part, by adhesive bonding or by stitching, for example). These elastic bands 40 are slightly stretched in their inactive state and intersect each other roughly in the center C of the ring 30, their fixed ends 40*a* being diametrically opposed. The elastic bands 40 are distributed radially in a regular manner and are attached in four pairs of two elastic bands 40 juxtaposed so as to be parallel and define eight approximately identical sectors.

In FIG. 3 it can be seen how these elastic bands 40 can move apart during the introduction of an object (not shown) between each pair of elastic bands, in such a way as to define a through opening 45 that, as closely as possible, matches the shape of said object. The elastic bands 40 of these closure means therefore all deform radially in the plane of the closure device.

In FIGS. 4 and 5, a second support ring 50 for the closure device 10 is shown. This also has an inside diameter D and a radial part to the outer surface 52 of which is attached a flexible fabric sleeve 60 of diameter D and of length L approximately equal to D, or slightly greater. This sleeve 60 acts as a closure member when working with the elastic bands 40, as will be seen later on in the description.

FIG. 6 shows how the two rings 30 and 50, the elastic bands 40 and the sleeve 60 are arranged and connected together axially. Thus, the end 62 of the sleeve 60 is fixed to the outer surface 52 of the second ring, e.g. by hot-melt adhesive bonding or by stitching. The sleeve 60 then passes through the center C of the first ring 30 and passes between each pair of elastic bands 40. It is at this location, roughly in the middle part M of the sleeve, that its diameter D is restricted by the elastic bands 40, such that the closure device 10 is effectively closed. The other end 64 of the sleeve 60 is then stitched or hot-melt bonded to the outer surface 32 of the first ring 30 so that each end of the sleeve 60 is folded out on each side of its middle part M.

To make the device 10 a single unit, the two rings 30 and 50 are then joined to each other (adhesive bonding or stitching) via the inner surface 54 of the second ring and the inner surface 34 of the first ring, preferably after first pivoting them axially with a rotation of about 90° with respect to each other in order to twist the sleeve and improve the closure of the device, by reducing the diameter of the through opening 45.

FIG. 7 shows how the middle part M of the sleeve 60 draws back as an object 100 passes through, pushing the elastic bands apart. The opening 45 therefore expands for as long as the object is passing through the sleeve.

Once this assembly has been prepared, all that is left is to fix the outer surface 32 of the first ring 30 to the container 1, as shown in FIG. 1.

When an object is to be inserted into the container 1, it has simply to be presented to the center of the closure device 10. By pushing the object (or the hand of the user), the user gradually separates all the elastic bands 40 and the sleeve 60 begins to draw back, offering a larger and larger passage to the object. Because of the structure of the closure device, the elastic bands 40 keep the sleeve 60 always closely around the object being inserted.

Varying the tension and the coefficient of elongation of the elastic bands 40 will increase or reduce the ease with which the closure device 10 opens. Objects of near to the inside diameter D of the rings (or of the sleeve) can thus be inserted if the elastic bands are pushed apart as far as they will go. The closure means therefore deform elastically radially when opened, that is to say in the plane of the ring, and not at right angles to the ring, into or out of the container. These elastic bands automatically return to the rest state when under no external stress at all (that is, stress not including their initial tension) once the object is withdrawn from or placed in the container, and the effect of this is to tend to close the sleeve.

It should however be understood that these examples are provided purely by way of illustration of the subject of the invention, of which they are in no sense a limitation.

Thus, the number and arrangement of the elastic bands may vary, although it is advisable for the elastic bands of each pair to be close up to each other.

The shape of the device may be other than circular, even though that is logically the simplest and most practical shape. For a square or rectangular shape (or any other parallelogram), pairs of elastic bands may connect the centers of the opposite sides and pairs of elastic bands may connect opposite angles, making four pairs of bands. For a triangular shape, the centers of each side may be connected to the opposite angle, making three pairs of elastic bands.

The tension and coefficient of elongation of the elastic bands may be variable depending on the difficulty with which it is wished to be able to introduce (and therefore also retain) the objects inside the container.

Another possibility is to have three concentric rings connected to each other:

Two outer rings to hold the sleeve and one inner ring to hold the elastic bands, these three rings being connected together axially later.

On the other hand, the elastic bands and the two folded ends of the sleeve may all be connected to a single ring (the elastic bands stitched to either of the faces and each end of the sleeve stitched to one face of the ring, on top of the elastic bands).

Clearly, uses other than under weightless conditions can be envisaged, for example when mountain climbing where manipulating objects inside the container can be made difficult, particularly if its opening is pointed down. The same applies to any kind of use where it is wished to be able to manipulate objects in a container without allowing them to escape, no matter what the orientation of the container and the position of its opening.

What is claimed is:

1. A container equipped with a closure device that permits a user to manipulate or withdraw an object placed within said container, wherein said closure device has a plane and is comprised of a closure mechanism that can deform elastically essentially in the plane of the closure device to change from a closed state of rest under no external stress to an open active state under an external stress, wherein the closure device comprises at least one rigid peripheral support structure attached to which is the closure mechanism that is comprised of elastically deformable elastic bands which intersect each other at a center of intersection and cooperate with each other to define an opening though which a sleeve having a diameter and forming a closure member extends, and which elastic bands surround the sleeve of the closure member at said center of intersection such that, when the elastically deformable elastic bands are in a state of rest under no external stress, the diameter of the sleeve is restricted by the elastic bands so that the closure member is closed.

2. The container as claimed in claim 1, wherein the rigid peripheral support structure is a rigid frame on which the elastically deformable elastic bands are stretched between two roughly opposite points.

3. The container as claimed in claim 1, wherein said container is a straight or curved cylinder provided with a closure device at each end.

4. The container as claimed in claim 1, further including at least a part made of a transparent material.

5. The container as claimed in claim 1, wherein the container is made of materials adapted for being used under weightless conditions.

6. A container equipped with a closure device that permits a user to manipulate or withdraw an object placed within said container, wherein said closure device has a plane and is comprised of a closure mechanism that can deform elastically essentially in the plane of the closure device to change from a closed state of rest under no external stress to an open active state under an external stress, wherein the closure device comprises at least one rigid peripheral support structure attached to which is the closure mechanism that is comprised of elastically deformable elastic bands which intersect each other and surround a sleeve having a diameter and forming a closure member such that, when the elastically deformable elastic bands are in a state of rest under no external stress, the diameter of the sleeve is restricted by the elastic bands so that the closure member is closed, the at least one rigid peripheral support structure is a rigid frame on which the elastically deformable elastic bands are stretched between two roughly opposite points, and the rigid peripheral support structure comprises at least one ring having an inside diameter and a center, and the elastically deformable elastic bands are attached in groups of two juxtaposed elastic bands defining a pair of elastic bands and fixed to the ring at their diametrically opposed ends.

7. The container as claimed in claim 6, wherein the sleeve of the closure member is made of flexible material having a length of at least twice the diameter, each end of the sleeve passes through each pair of elastic bands in the center of the ring, where the sleeve is contracted radially in the closed rest state of the device, or defines a single through opening for the object in the open state of the device, in which state the elastic bands are deformed radially.

8. The container as claimed in claim 7, wherein one end of the sleeve is fixed peripherally to an outer face of a first ring and the other end of said sleeve is fixed peripherally to an opposite outer face of a second ring identical to the first ring, the sleeve being contracted radially in a middle zone between each pair of elastic bands, the elastic bands being attached to the first or second rings which are themselves fixed to each other via their inner faces.

9. The container as claimed in claim 8, wherein the first and second rings are angularly offset at 90° with respect to each other.

10. The container as claimed in claim 8, wherein the first and second rings are held together by adhesive bonding or by stitching.

11. The container as claimed in claim 7, wherein the sleeve is made of fabric.

12. The container as claimed in claim 7, wherein the elastic bands are eight in number and the pairs of juxtaposed bands are distributed in such a way as to pass through the center of their corresponding supporting ring so as to form in the respective supporting ring eight essentially identical sectors.

13. The container as claimed in claim 7, wherein the elastic bands are under tension on their corresponding supporting ring in the closed state of the device.

14. The container as claimed in claim 6, wherein the elastically deformable elastic bands of said closure mechanism keep the sleeve closely around an object while being placed within the container.

* * * * *